US010415309B2

(12) United States Patent
Liu et al.

(10) Patent No.: US 10,415,309 B2
(45) Date of Patent: Sep. 17, 2019

(54) HOISTING DEVICE FOR WORKING IN HEIGHTS

(71) Applicant: FICONT INDUSTRY (BEIJING) Co., Ltd., Beijing (CN)

(72) Inventors: Zhixin Liu, Beijing (CN); Xijun Eugene Wang, Beijing (CN)

(73) Assignee: Ficont Industry (Beijing) Co., Ltd., Beijing (CN)

( * ) Notice: Subject to any disclaimer, the term of this patent is extended or adjusted under 35 U.S.C. 154(b) by 0 days.

(21) Appl. No.: 15/519,227

(22) PCT Filed: Jun. 26, 2015

(86) PCT No.: PCT/CN2015/082568
§ 371 (c)(1),
(2) Date: Apr. 14, 2017

(87) PCT Pub. No.: WO2016/065915
PCT Pub. Date: May 6, 2016

(65) Prior Publication Data

US 2017/0241202 A1 Aug. 24, 2017

(30) Foreign Application Priority Data

Oct. 27, 2014 (CN) ..... 2014 1 0577207

(51) Int. Cl.
*E06C 7/12* (2006.01)
*E06C 1/39* (2006.01)
(Continued)

(52) U.S. Cl.
CPC ..... *E06C 1/39* (2013.01); *B66F 11/04* (2013.01); *E06C 7/12* (2013.01); *E06C 7/16* (2013.01); *E06C 7/18* (2013.01)

(58) Field of Classification Search
CPC ..... E06C 7/12; E06C 7/16; E06C 7/18; E06C 7/186; E06C 7/187; E06C 1/39; B66D 1/7415; B66D 1/7405
See application file for complete search history.

(56) References Cited

U.S. PATENT DOCUMENTS 593,392 A * 11/1897 Fitch ..... B66B 9/187 187/241
2,394,148 A * 2/1946 Campbell ..... E06C 7/12 182/103
(Continued)

FOREIGN PATENT DOCUMENTS

CN 201071290 Y 6/2008
CN 101216378 A 7/2008
(Continued)

OTHER PUBLICATIONS

Search Report dated Sep. 30, 2018 from corresponding Chinese Application 201410577207.5.

*Primary Examiner* — Daniel P Cahn
(74) *Attorney, Agent, or Firm* — Porter Wright Morris & Arthur LLP

(57) ABSTRACT

The present invention provides a hoisting device for working in heights, specifically including a vehicle body, a lower bracket installed at a bottom of a safety ladder, a host driver fixed on the lower bracket and providing lifting power, an upper bracket installed at a top of the safety ladder, a traction rope connecting the upper bracket, the vehicle body and the host driver, and a sliding rail installed on the safety ladder, and further including a fall arrester installed on the sliding rail, a guiding device assembly installed on a back portion of the vehicle body, a stall protection device installed on the vehicle body and matched with the sliding rail, a collapsible pedal installed on a lower portion of the vehicle body and configured to carry people and goods, an operation handle
(Continued)

fixed to an upper portion of the vehicle body and a position-limiting bracket installed on an upper portion of the safety ladder. The host driver drives, trough the traction rope, the vehicle body to ascend or descend along the sliding rail, thus enabling the vehicle body to ascend or descend so as to convey people and goods. The hoisting device is simple and convenient to operate, occupies a small floor space and can be installed without changing a structure of an original safety ladder.

8 Claims, 8 Drawing Sheets

(51) Int. Cl.

| | |
|---|---|
| ***B66F 11/04*** | (2006.01) |
| ***E06C 7/16*** | (2006.01) |
| ***E06C 7/18*** | (2006.01) |

(56) References Cited

U.S. PATENT DOCUMENTS

| | | | | | |
|---|---|---|---|---|---|
| 2,894,605 | A * | 7/1959 | Leavitt | B66F 9/06 | 182/103 |
| 3,115,211 | A * | 12/1963 | Ostrander, Jr. | E06C 7/12 | 182/103 |
| 3,428,145 | A * | 2/1969 | Lyon | E06C 7/16 | 182/103 |
| 3,476,212 | A * | 11/1969 | Eakins | E06C 7/16 | 182/103 |
| 3,752,263 | A * | 8/1973 | Thevenot | E04G 1/20 | 182/148 |
| 3,799,289 | A * | 3/1974 | Cecere, Jr. | B66B 9/16 | 182/103 |
| 3,951,286 | A * | 4/1976 | Horst | B62B 1/14 | 187/235 |
| 4,049,081 | A * | 9/1977 | McDonald | B66B 9/00 | 182/103 |
| 4,183,423 | A * | 1/1980 | Lewis | B66B 9/16 | 182/103 |
| 4,512,440 | A * | 4/1985 | Bixby | B66B 9/16 | 182/134 |
| 4,706,779 | A * | 11/1987 | Bono | B66B 9/16 | 182/103 |
| 4,875,547 | A * | 10/1989 | Hanthorn | B66B 9/16 | 182/102 |
| 4,930,599 | A * | 6/1990 | Simms, Sr. | B66B 9/16 | 182/103 |
| 6,244,381 | B1 * | 6/2001 | Ruble | B66B 9/187 | 182/103 |
| 6,283,249 | B1 * | 9/2001 | Young | B66B 9/16 | 182/12 |
| 6,371,449 | B1 * | 4/2002 | Chamberlain | B25H 1/0014 | 254/10 C |
| 6,533,070 | B1 * | 3/2003 | Elrod | E06C 1/345 | 182/103 |
| 8,162,108 | B2 | 4/2012 | Sirigu et al. | | |
| 8,875,839 | B1 * | 11/2014 | Licea | A62B 35/005 | 182/5 |
| 8,887,865 | B2 * | 11/2014 | Matharu | E06C 7/186 | 182/8 |
| 8,905,701 | B2 * | 12/2014 | Van Der Helm | B62B 1/10 | 187/253 |
| 9,834,944 | B2 * | 12/2017 | Maurer | E04G 3/28 | |
| 2007/0267250 | A1 * | 11/2007 | Wolff | E06C 7/081 | 182/103 |
| 2008/0035425 | A1 * | 2/2008 | Meitus | A62B 1/10 | 182/129 |
| 2008/0142298 | A1 * | 6/2008 | Blasek | E06C 7/12 | 182/101 |
| 2008/0190706 | A1 * | 8/2008 | Franklin | B66B 9/027 | 187/251 |
| 2009/0249712 | A1 * | 10/2009 | Brickell | A62B 1/10 | 52/173.1 |
| 2009/0288913 | A1 * | 11/2009 | Nielsen | A62B 1/06 | 182/8 |
| 2010/0219016 | A1 * | 9/2010 | Meillet | E06C 7/186 | 182/8 |
| 2013/0095968 | A1 * | 4/2013 | Stephenson | B66D 1/7405 | 474/137 |
| 2013/0153334 | A1 * | 6/2013 | Crew | E06C 7/12 | 182/18 |
| 2014/0060970 | A1 * | 3/2014 | Zwirn | E06C 7/12 | 182/42 |
| 2015/0273250 | A1 * | 10/2015 | Bina | A62B 99/00 | 182/8 |
| 2015/0275579 | A1 * | 10/2015 | Reyes | E06C 7/16 | 182/103 |
| 2015/0300090 | A1 * | 10/2015 | Strand | E06C 7/12 | 182/103 |

FOREIGN PATENT DOCUMENTS

| | | | |
|---|---|---|---|
| CN | 201261671 | Y | 6/2009 |
| CN | 101472830 | A | 7/2009 |
| CN | 201321317 | Y | 10/2009 |
| CN | 202729536 | U | 2/2013 |
| CN | 202729537 | U | 2/2013 |
| CN | 203486859 | U | 3/2014 |
| CN | 203754358 | U | 8/2014 |
| CN | 104276530 | A | 1/2015 |
| CN | 204281227 | U | 4/2015 |
| GB | 2493283 | A | 1/2013 |
| JP | 2004131216 | A | 4/2004 |
| TW | 200906706 | A | 2/2009 |
| WO | 2012039643 | A1 | 3/2012 |

* cited by examiner

HOISTING DEVICE FOR WORKING IN HEIGHTS

TECHNICAL FIELD OF THE INVENTION

The present invention relates to the technical field of hoisting devices, and particularly to a hoisting device for working in heights.

BACKGROUND OF THE INVENTION

At present, working at heights is generally required in the field of wind power generation, and a certain hoisting device needs to be utilized to convey people and goods between an aerial working platform and the ground.

A traditional lifting device is constructed at a high cost and occupies a large space, and the installation space of the traditional lifting device is usually limited. Besides, the operator, who climbs simply using a climb assisting device, will exhaust physically. Therefore, working efficiency will be also affected by the huge physical exertion caused by the climbing of the operator. So, this present invention of hoisting device working in heights comes into being. The present invention, which is a revolutionary finished product among tower tubes of fans and other aerial climb assisting devices, uses a safety ladder while integrating a function of assisting a climber to ascend and descend and a function of conveying maintenance goods, thereby greatly reducing physical exertion caused during climbing of working personnel, largely reducing maintenance cost and improving the working efficiency of the working personnel.

SUMMARY OF THE INVENTION

A major purpose of the present invention is to provide a hoisting device for working in heights to solve the problem that a conveying device of an aerial working platform, comprising an existing fan tower tube and so on is large in volume and high in operation cost with high installation requirements and large physical exertion is caused to personnel using a climb assisting device.

The present invention provides a hoisting device for working in heights to achieve the purpose, comprising: a sliding rail; an installation bracket, wherein the sliding rail is installed on a safety ladder through the installation bracket; a vehicle body, installed on the sliding rail; a host driver, driving the vehicle body to move on the sliding rail.

Further, the hoisting device further comprises a pulley block and a traction rope, and the pulley block comprises a fixed pulley and an upper idle pulley. The fixed pulley is installed on the safety ladder, and the upper idle pulley is installed on the vehicle body, wherein a first end of the traction rope is fixed on the safety ladder, and the traction rope passes through the upper idle pulley and the fixed pulley in turn and is finally drivably connected with the host driver.

Further, the pulley block further comprises a lower idle pulley, wherein the lower idle pulley is installed on the vehicle body and a second end of the traction rope passes through the lower idle pulley and is fixed on the safety ladder.

Further, the hoisting device further comprises a tensioning device, wherein the tensioning device is arranged at the second end of the traction rope and the traction rope is tensioned by the tensioning device.

Further, the tensioning device comprises an adjusting screw rod, a bearing, a spring and a locking member, wherein the adjusting screw rod is installed on the safety ladder, one end of the bearing presses against the adjusting screw rod, the other end of the bearing presses against the spring, the spring is pressed tightly on the bearing by the locking member, the first end of the traction rope or the second end of the traction rope is connected with the locking member.

Further, the installation bracket comprises the upper bracket and a lower bracket; the upper bracket is located above the lower bracket in a vertical direction; the fixed pulley is installed on the upper bracket; the first end of the traction rope is fixed on the upper bracket and the second end of the traction rope is fixed on the lower bracket through the tensioning device; the adjusting screw rod is installed on the lower bracket.

Further, the hoisting device further comprises a pedal, and the pedal is arranged outside the vehicle body in a collapsible manner.

Further, the hoisting device further comprises an operation handle; the operation handle is arranged on the vehicle body; the operation handle is drivably connected with the host driver and controls the host driver to work.

Further, the hoisting device further comprises a guiding device assembly; the guiding device assembly is installed on the vehicle body and matched with the sliding rail.

Further, the hoisting device further comprises a stall protection device; the stall protection device is installed between the vehicle body and the sliding rail.

Further, the host driver comprises: a decelerating motor, a driving wheel, a cable pressing wheel and a pressing spring, wherein the driving wheel is installed on an output end of the decelerating motor; the cable pressing wheel is installed on the output end of the decelerating motor and arranged opposite to the driving wheel, wherein the traction rope passes between the driving wheel and the cable pressing wheel; and the pressing spring, arranged on the cable pressing wheel to apply a force to the cable pressing wheel to force the cable pressing wheel and the driving wheel to clamp the traction rope tightly.

Further, the hoisting device further comprises an upper position-limiting switch and a lower position-limiting switch; the upper position-limiting switch is arranged on the vehicle body and the lower position-limiting switch is arranged on a lower portion of the safety ladder.

Further, the hoisting device further comprises a fall arrester, and the fall arrester is slidably arranged on the sliding rail.

The present invention comprises a vehicle body, a lower bracket installed at a bottom of a safety ladder, a host driver fixed on the lower bracket and providing device operating power, an upper bracket installed at a top of the safety ladder, a traction rope connecting the upper bracket, the vehicle body and the host driver and driving the vehicle body to operate, and a sliding rail installed on the safety ladder and providing guiding and safety protection, and further comprising a fall arrester installed on the sliding rail, a guiding device assembly installed on a back portion of the vehicle body, a stall protection device installed on the sliding rail and matched with the vehicle body, a collapsible pedal installed on a lower portion of the vehicle body and configured to carry people and goods, and an operation handle fixed on an upper portion of the vehicle body. The host driver drives the vehicle body to move along the sliding rail so as to ascend and descend the vehicle body and convey people and goods, wherein the upper bracket is installed at an upper end of the safety ladder, the lower bracket is fixed to a lower end of the safety ladder so as to play a position-limiting function and a fixing function, wherein the sliding rail is installed in a middle of the safety ladder to play a guiding and protecting function, wherein an upper idle pulley is installed on an upper end inside the vehicle body, and a lower idle pulley is installed on a lower end; a guiding device assembly is installed at a back portion of the vehicle body and is matched with the sliding rail to implement guiding; two collapsible pedals are installed at the lower portion of the vehicle body and an upper portion of the vehicle body is installed with the operation handle, wherein the traction rope is fixed by a single anchor of the upper bracket, and passes through the upper idle pulley in the vehicle body, a single fixed pulley of the upper bracket, a first idle pulley, a driving wheel, a second idle pulley and the lower idle pulley in the vehicle body; the traction rope is tensioned by a tensioning device, and the vehicle body is installed on the sliding rail to convey people and goods, wherein the host driver is composed of a decelerating motor, a pressing device, a first idle pulley, a second idle pulley and a fixing plate, wherein the pressing device is composed of the driving wheel, a cable pressing wheel, and a pressing spring, wherein the host driver is installed on the lower bracket so as to ascend and descend the vehicle body, wherein the fall arrester is installed on the sliding rail to prevent an operator from high-altitude falling, wherein the stall protection device is installed between the vehicle body and the sliding rail, and an external clamping tongue of the stall protection device is connected with the vehicle body via a pin to prevent the vehicle body from stall falling.

The volume of a hoisting device for working in heights is optimized and reduced in consideration of a practical working environment, so as to facilitate conveyance, installation and maintenance of the device and the hoisting device is operated more conveniently by an operator. Further, power driving of the hoisting device is optimized to change double driving into single driving so that the hoisting device is safer and operates more stably compared with other previous aerial devices assisted by double driving. The hoisting device is installed with the fall arrester and the stall protection device for safety protection. Double protection structures are arranged to ensure safe working. The fall arrester is installed on the sliding rail and the stall protection device is installed between the vehicle body and the sliding rail to form a safety protection system jointly.

Besides the foregoing purpose, characteristics and advantages, the present invention also has other purposes, characteristics and advantages. The present invention will be further expounded below with reference to the drawings.

BRIEF DESCRIPTION OF THE DRAWINGS

The accompanying drawings in the specification, which constitute a part of the present invention, are used for providing further understanding to the present invention. The exemplary embodiments of the present invention and the illustration thereof are used for explaining the present invention, instead of constituting an improper limitation to the present invention. In the accompanying drawings.

wherein the accompanying drawings include the following numerals:

1. Upper bracket; 2. Sliding rail; 3. Fall arrester; 4. Traction rope; 5. Vehicle body; 6. Pedal; 7. Lower bracket; 8. Tensioning device; 9. Host driver; 10. 11. Stall protection device; 12. Guiding device assembly; 13. Operation handle; 14. Safety ladder; 15. Fixed pulley; 16. Position-limiting bracket; 17. Anchor; 18. Lower position-limiting switch; 19. Adjusting screw rod; 20. Bearing; 21. Spring; 22. Locking member; 23. Driving wheel; 24. First idle pulley; 25. Second idle pulley; 26. Cable pressing wheel; 27. Pressing spring; 28. Fixing plate; 29. Guiding wheel; 30. Lower fixing plate; 31. Upper fixing plate; 32. Upper position-limiting switch; 33. Upper idle pulley; 34. Lower idle pulley; 35. Pin; 36. External clamping tongue; 37. Pressing plate; 38. Decelerating motor; 39. Decelerating motor output shaft

DETAILED DESCRIPTION OF THE EMBODIMENTS

It needs to be noted that the embodiments in the present invention and the characteristics in the embodiments may be combined with each other if there is no conflict. The present invention will be expounded below with reference to the accompanying drawings and in combination with the embodiments.

To enable those skilled in the art to better understand the solutions of the present invention, the technical solution in the embodiments of the present invention will be described clearly and fully hereinafter in combination with the accompanying drawings in the embodiments of the present invention. Apparently, the embodiments described herein are only some embodiments of the present invention, rather than all embodiments of the present invention. Any other embodiments obtained based on the embodiments in the present invention by those of ordinary skill in the art without inventive efforts shall fall within the scope of protection of the present invention.

Figure 1:
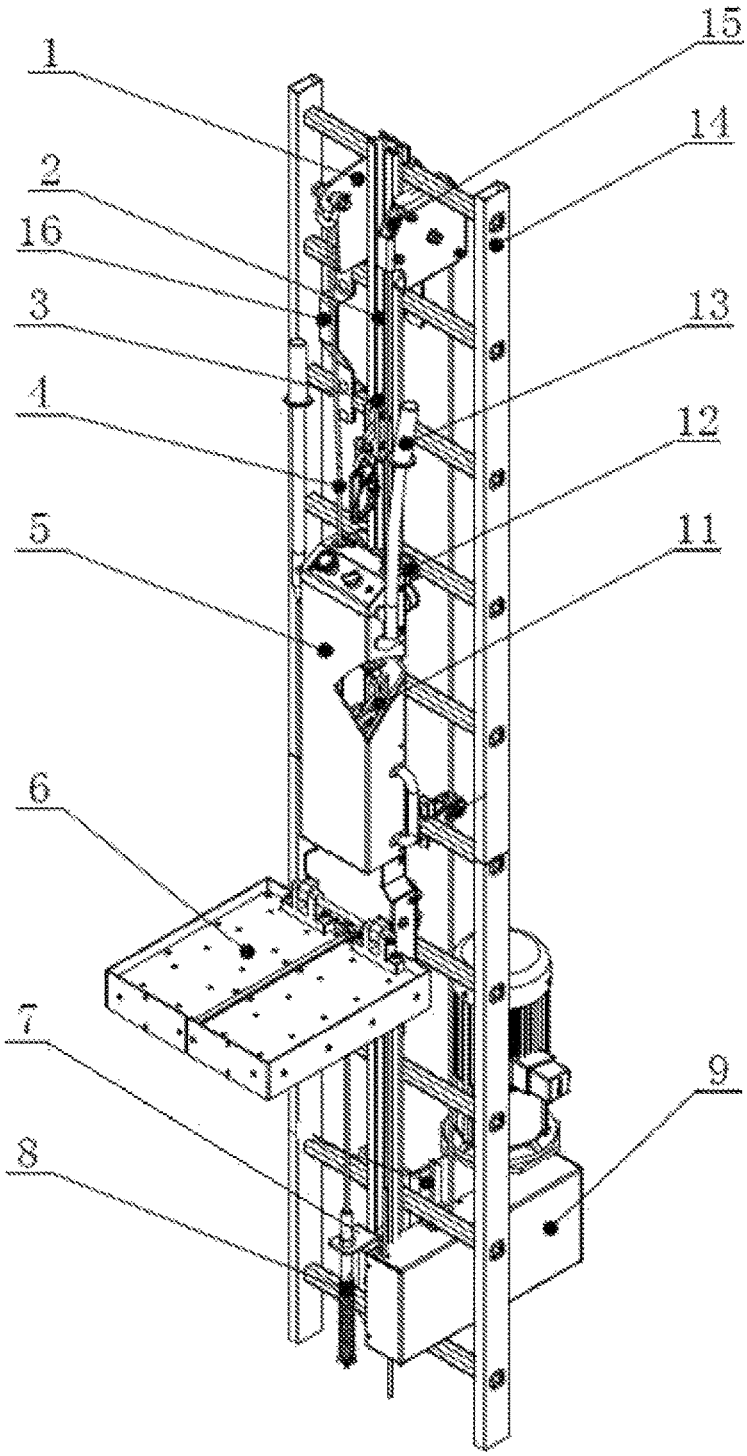
FIG. 1 is an overall structural diagram of a hoisting device for working in heights of the present invention.
Figure 2:
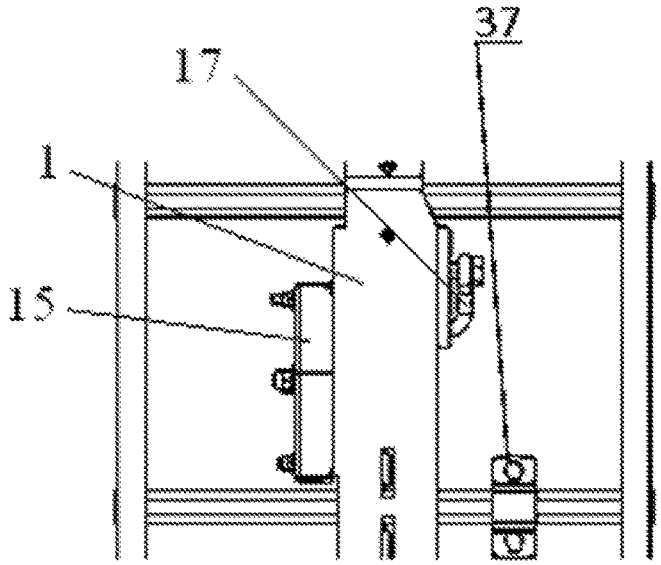
FIG. 2 is a rear view of a fixed pulley of a hoisting device for working in heights of the present invention.
Figure 3:
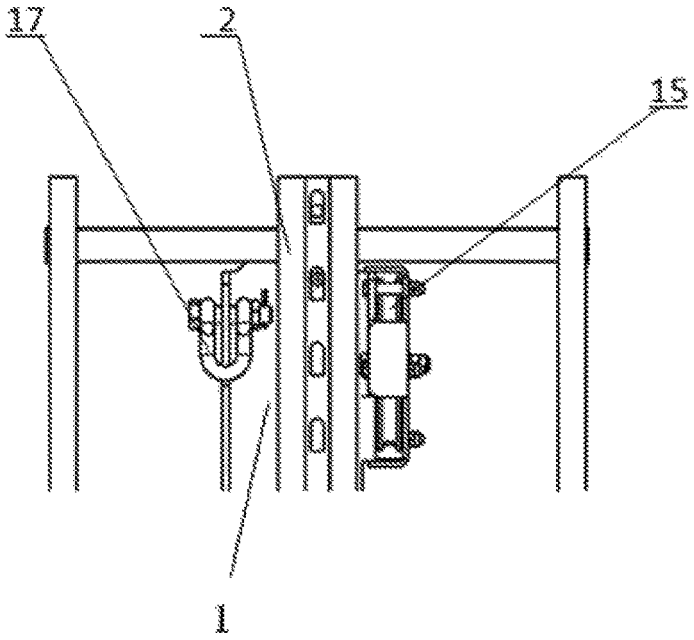
FIG. 3 is a front view of a fixed pulley of a hoisting device for working in heights of the present invention.
Figure 4:
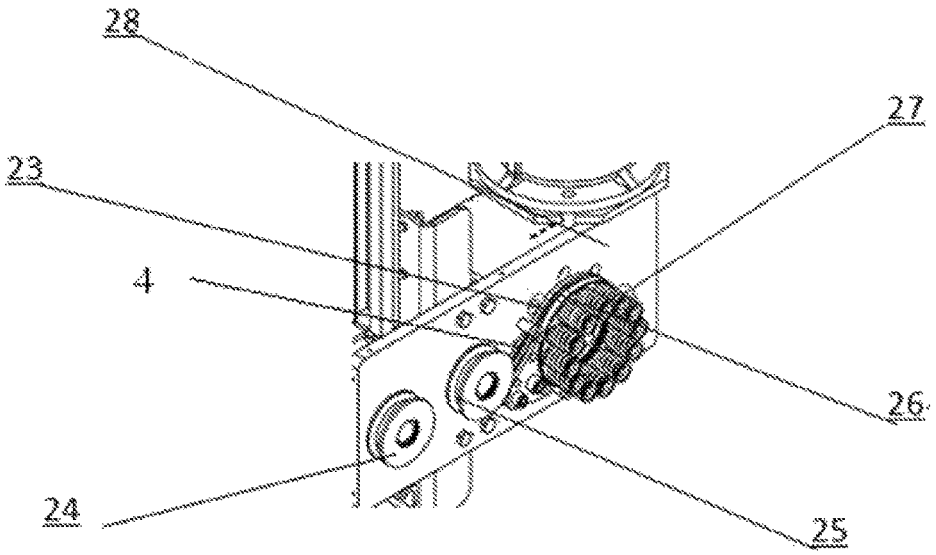
FIG. 4 is a schematic diagram of a cable pressing wheel and a driving wheel in a host driver of a hoisting device for working in heights of the present invention.
Figure 5:
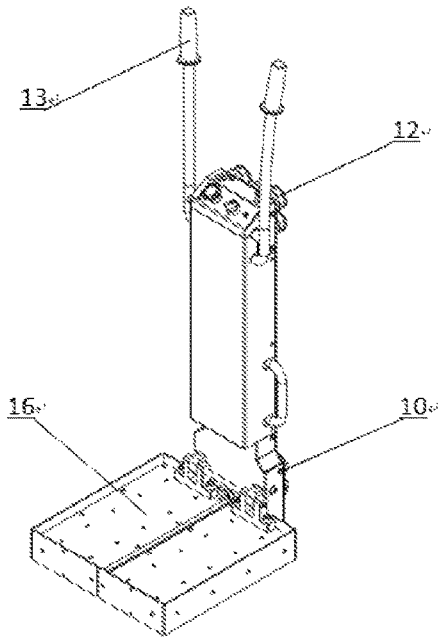
FIG. 5 is a front view of a vehicle body of a hoisting device for working in heights of the present invention.
Figure 6:
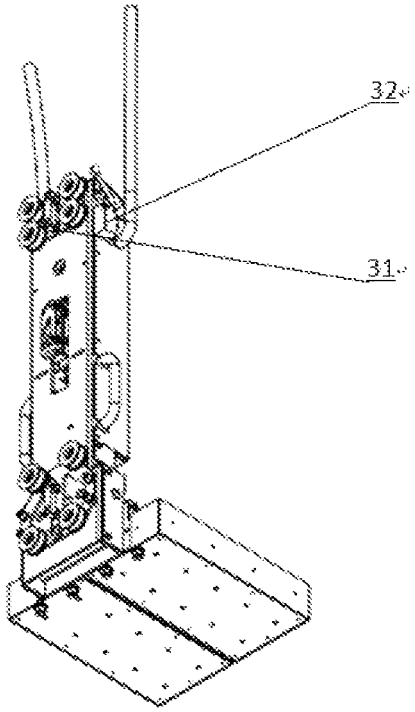
FIG. 6 is a back view of a vehicle body of a hoisting device for working in heights of the present invention.
Figure 7:
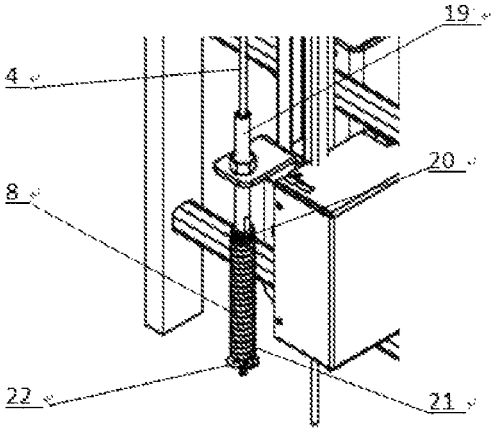
FIG. 7 is a schematic diagram of a tensioning device installed on a lower bracket of a hoisting device for working in heights of the present invention.
Figure 8:
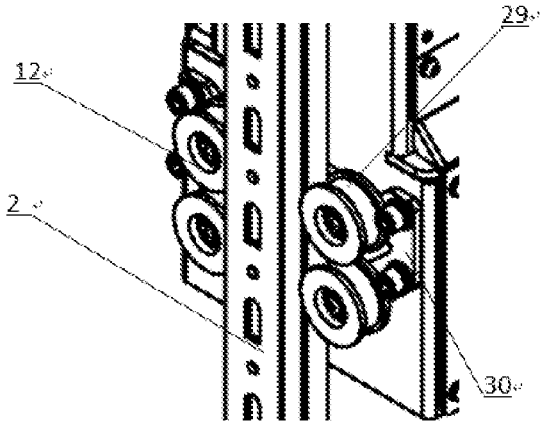
FIG. 8 is a schematic diagram of a guiding device assembly installed on a vehicle body of a hoisting device for working in heights of the present invention.
Figure 9:
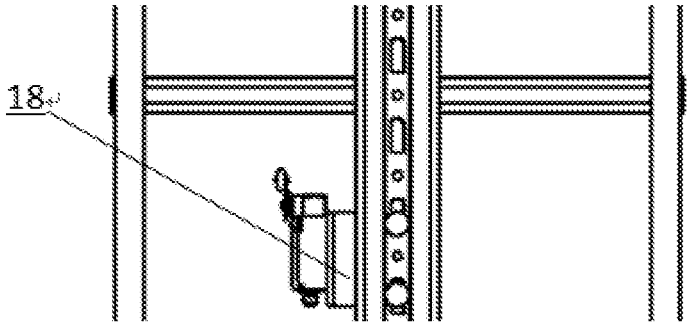
FIG. 9 is a schematic diagram of a position-limiting switch installed at the bottom of a safety ladder of a hoisting device for working in heights of the present invention.
Figure 10:
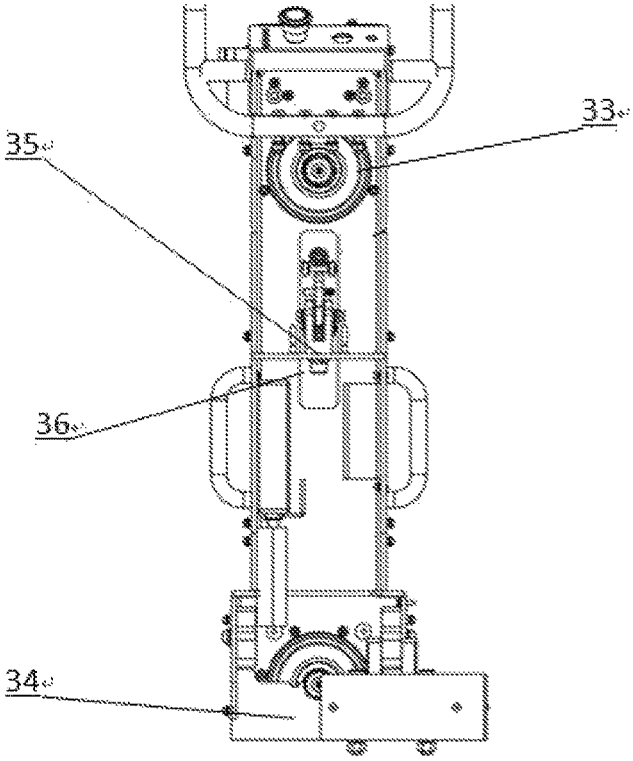
FIG. 10 is a schematic diagram of the interior of a vehicle body of a hoisting device for working in heights of the present invention.
Figure 11:
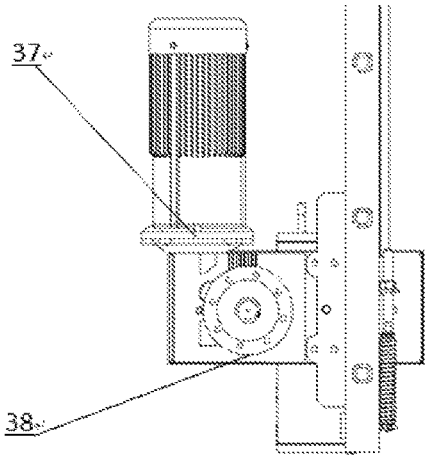
FIG. 11 is a diagram of a decelerating motor applied to a host driver of a hoisting device for working in heights of the present invention.
Figure 12:
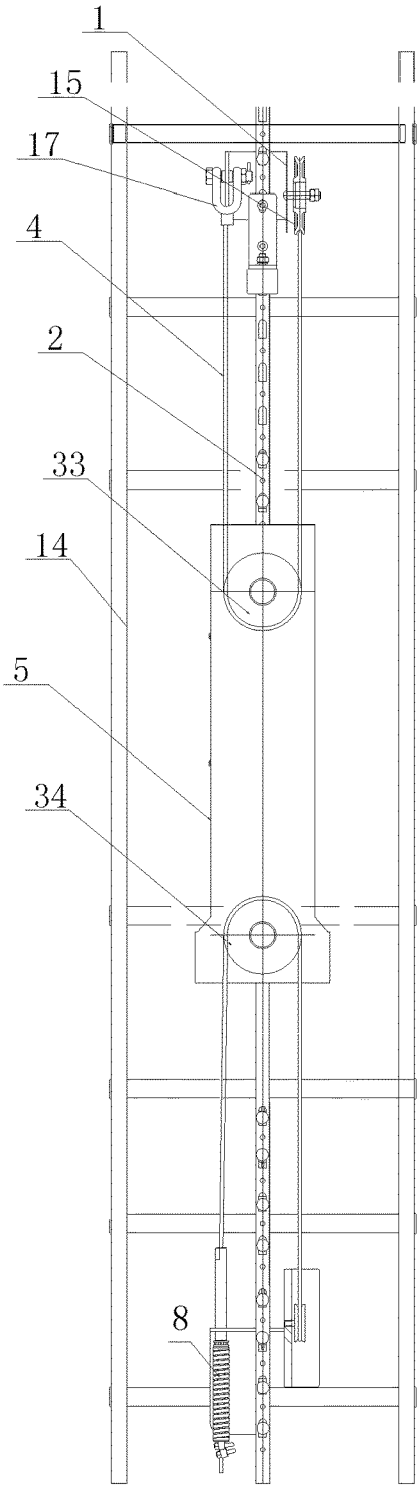
FIG. 12 is a schematic diagram of the pulley arrangement of a hoisting device for working in heights of the present invention.
Figure 13:
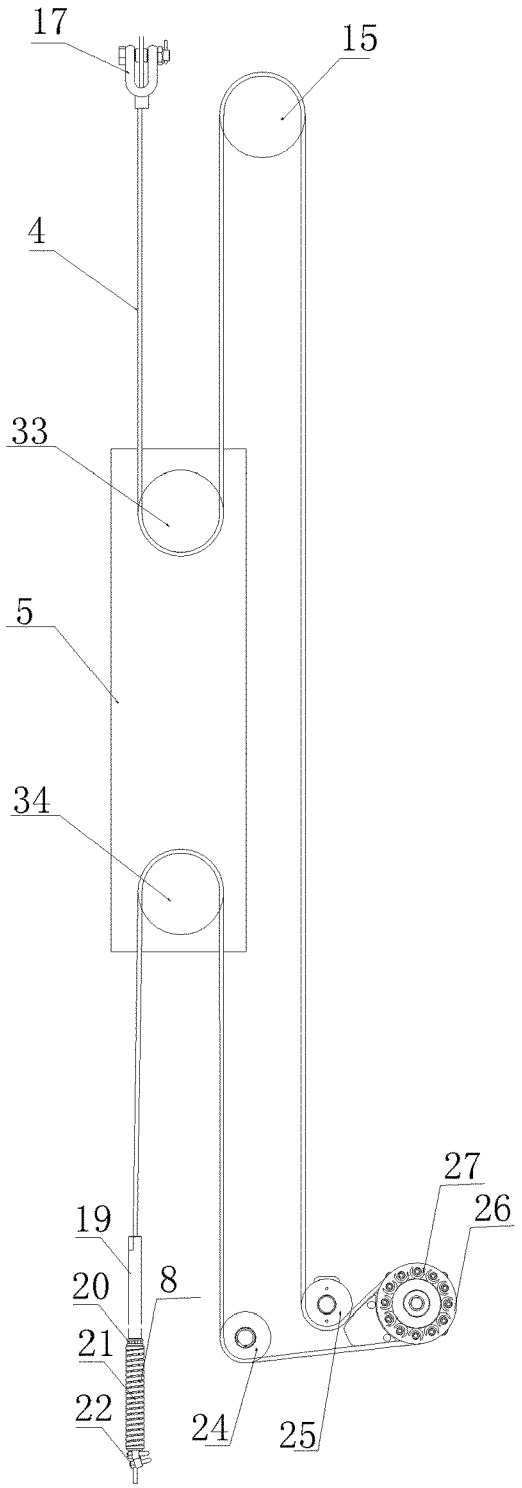
FIG. 13 is a schematic diagram of the arrangement of the traction rope of a hoisting device for working in heights of the present invention.

As shown in FIG. 1 to FIG. 11, a hoisting device for working in heights of the present embodiment includes: a lower bracket 7 installed at a bottom of a safety ladder 14, a host driver 9 fixed on the lower bracket 7 by a fixing plate 28 and providing lifting power, a tensioning device 8 fixed on the lower bracket 7, an upper bracket 1 installed at a top of the safety ladder 14, a fixed pulley 15 installed on the upper bracket 1, a sliding rail 2 installed on the safety ladder 14, a position-limiting bracket 16 installed on an upper portion of the safety ladder 14, and further including a fall arrester 3 installed on the sliding rail 2 and a vehicle body 5, a guiding device assembly 12 installed on a back portion of the vehicle body 5, a stall protection device 11 installed on the sliding rail 2 and matched with the vehicle body 5, a collapsible pedal 6 installed at a lower portion of the vehicle body 5 and configured to carry people and goods, and an operation handle 13 fixed on an upper portion of the vehicle body 5.

One end of a traction rope 4 is fixed on an anchor 17 of the upper bracket 1 at the top of the safety ladder 14, runs downwards across an upper idle pulley 33 of the vehicle body 5, extends upwards and then runs across a fixed pulley 15 of the upper bracket 1, extends downwards into a second idle pulley 25, a driving wheel 23 and the first idle pulley 24 installed in the host driver 9, and extends upwards across a lower idle pulley 34 of the vehicle body 5 and passes through the tensioning device 8 installed on the lower bracket 7. A tensioning force of the traction rope 4 is adjusted by an adjusting screw rod 19 so as to tension the traction rope. A collapsible pedal 6 configured to carry people and goods is installed on the lower portion of the vehicle body 5. A cable pressing wheel 26 of the host driver 9 presses the traction rope 4 on the driving wheel 23. A pressure is regulated by a pressing spring 27 to press the traction rope 4 tightly. The sliding rail 2 is fixed on the safety ladder 14. Fixed by a standard member and a pressing plate 37, the guiding device assembly 12 is installed on the upper portion and the lower portion of the vehicle body 5, and a plurality of guiding wheels 29 are arranged on an upper portion and a lower portion of the guiding device assembly 12. The guiding wheels 29 are fixed on an upper fixing plate 31 and a lower fixing plate 30. The guiding wheels 29 are located at two sides of the sliding rail 2 and are abutted against the sliding rail 2. Guiding is implemented by rolling of the guiding wheels 29 along the sliding rail 2. The stall protection device 11 is installed on the vehicle body 5. An external clamping tongue 36 of the stall protection device 11 is connected with the vehicle body 5 through a pin 35. The fall arrester 3 is installed on the sliding rail 2 above the vehicle body 5. The position-limiting bracket 16 is installed at the top of the safety ladder 14 and a lower position-limiting switch 18 is installed at the bottom of the safety ladder 14.

The driving wheel 23 is provided with a connecting rod 231, the connecting rod 231 passes through the cable pressing wheel 26, the pressing spring 27 is arranged on the connecting rod 231, the pressing spring 27 presses the cable pressing wheel 26.

During normal operation, the host driver 9 drives the vehicle body 5 on the traction rope 4 to ascend and descend along the sliding rail 2 so as to convey people and goods. When the vehicle body 5 reaches the top of the safety ladder 14, the position-limiting bracket 16 triggers the upper position-limiting switch 32 on the vehicle body 5 and the host driver 9 stops operating so as to prevent the vehicle body 5 from exceeding the highest working height. When the vehicle body 5 reaches the bottom of the safety ladder 14, the vehicle body 5 triggers the lower position-limiting switch 18 on the safety ladder 14, and the host driver 9 stops operating so as to prevent the vehicle body 5 from exceeding the lowest working height. The guiding device assembly 12 is matched with the sliding rail 2 to guide the vehicle body 5. The fall arrester 3 is connected with a safety suit of an operator and installed on the sliding rail 2 to prevent the operator from falling. The stall protection device 11 is connected with the vehicle body 5 and installed on the sliding rail 2. The stall protection device will clamp the sliding rail as soon as the vehicle body and the operator fall, thereby ensuring the safety of the vehicle body and the operator. When used normally, the collapsible pedal 6 is configured to carry people and goods, and may be collapsed upwards in emergency to provide a safety passageway for the operator.

To sum up, the present invention is convenient to install without affecting the structure of an original safety ladder, simple to operate and extremely applicable to convey people and goods of an aerial working platform including a tower tube of a fan and so on. Besides, the sliding rail is used as a part of falling prevention, which is more guaranteed than other similar climb assisting devices.

The above are only preferred embodiments of the present invention, and are not used for limiting the present invention. For those skilled in the art, the present invention may have various alterations and variations. Any modification, equivalent replacement, improvement and so on made within the spirit and principle of the present invention should be included within the scope of protection of the present invention.

The invention claimed is:

1. A hoisting device for working in heights, comprising:

(a) a sliding rail (2);

(b) an installation bracket, wherein the sliding rail (2) is installed on a safety ladder (14) through the installation bracket, wherein the installation bracket comprises an upper bracket (1) and a lower bracket (7), and the upper bracket (1) is located above the lower bracket (7) in a vertical direction;

(c) a vehicle body (5), installed on the sliding rail (2);

(d) a host driver (9), configured for driving the vehicle body (5) to move on the sliding rail (2);

(e) a traction rope (4); and (f) a pulley block, wherein the pulley block comprises:

a fixed pulley (15), installed on the upper bracket (1), wherein the upper bracket (1) is installed on the sliding rail (2);

an upper idle pulley (33), installed on the vehicle body (5), a lower idle pulley (34), installed on the vehicle body (5); and a tensioning device (8), arranged at the sliding rail (2) through the lower bracket (7);

wherein a first end of the traction rope (4) is fixed on the safety ladder (14), and the traction rope (4) passes through the upper idle pulley (33), the fixed pulley (15), the host driver (9), and the lower idle pulley (34) in turn and is drivably connected with the tensioning device (8), the tensioning device (8) is arranged at a second end of the traction rope (4), and the traction rope (4) is tensioned by the tensioning device (8); and wherein the host driver (9) comprises:

a decelerating motor (38);

a driving wheel (23), installed on an output end of the decelerating motor (38);

a cable pressing wheel (26), installed on the output end of the decelerating motor (38) and arranged opposite to the driving wheel (23), wherein the traction rope (4) passes between the driving wheel (23) and the cable pressing wheel (26); and a pressing spring (27), arranged on the cable pressing wheel (26) to apply a force to the cable pressing wheel (26) to force the cable pressing wheel (26) and the driving wheel (23) to clamp the traction rope (4).

2. The hoisting device for working in heights according to claim 1, wherein the tensioning device (8) comprises an adjusting screw rod (19), a bearing (20), a spring (21) and a locking member, and wherein the adjusting screw rod (19) is installed on the safety ladder (14), one end of the bearing (20) presses against the adjusting screw rod (19), another end of the bearing (20) presses against the spring (21), the spring (21) is pressed on the bearing (20) by the locking member, and the second end of the traction rope (4) is connected with the locking member.

3. The hoisting device for working in heights according to claim 1, wherein the hoisting device further comprises a pedal (6), and the pedal (6) is arranged outside the vehicle body (5) in a collapsible manner.

4. The hoisting device for working in heights according to claim 1, wherein the hoisting device further comprises an operation handle (13); the operation handle (13) is arranged on the vehicle body (5); and the operation handle (13) is drivably electrically connected with the host driver (9) and configured to control the host driver (9) to work.

5. The hoisting device for working in heights according to claim 1, wherein the hoisting device further comprises a guiding device assembly (12); and the guiding device assembly (12) is installed on the vehicle body (5) and matched with the sliding rail (2).

6. The hoisting device for working in heights according to claim 1, wherein the hoisting device further comprises a stall protection device (11); and the stall protection device (11) is installed between the vehicle body (5) and the sliding rail (2).

7. The hoisting device for working in heights according to claim 1, wherein the hoisting device further comprises an upper position-limiting switch (32) and a lower position-limiting switch (18); and the upper position-limiting switch (32) is arranged on the vehicle body (5) and the lower position-limiting switch (18) is arranged on a lower portion of the safety ladder (14).

8. The hoisting device for working in heights according to claim 1, wherein the hoisting device further comprises a fall arrester (3), and the fall arrester (3) is slidably arranged on the sliding rail (2).

* * * * *